United States Patent [19]

Veach

[11] 4,196,553

[45] Apr. 8, 1980

[54] END JOINING PIECE ADAPTABLE TO EITHER HOLLOW OR INSULATED BACKING SIDING

[76] Inventor: Clifton R. Veach, 6099 Alice Dr., Westerville, Ohio 43081

[21] Appl. No.: 869,679

[22] Filed: Jan. 16, 1978

[51] Int. Cl.[2] ..... E04F 19/02

[52] U.S. Cl. ..... 52/276; 52/288

[58] Field of Search ..... 52/276, 288, 211, , 52/573, 278, 531, 532

[56] References Cited

U.S. PATENT DOCUMENTS

| | | | |
|---|---|---|---|
| 3,206,806 | 9/1965 | Powell | 52/288 |
| 3,304,676 | 2/1967 | Sallie et al. | 52/276 |
| 3,462,900 | 8/1969 | Morrissey | 52/288 |
| 3,486,281 | 12/1969 | Gregoire | 52/288 X |
| 3,500,600 | 3/1970 | Bagley | 52/288 X |
| 3,525,188 | 8/1970 | Torbett | 52/737 |

*Primary Examiner*—J. Karl Bell

*Attorney, Agent, or Firm*—Anthony D. Cennamo

[57] ABSTRACT

An inside and outside corner for construction material used as siding, roofing, paneling and the like. The corner in its natural position has a diameter (depth) sufficient to accommodate siding material with an insulating backing. The corner piece has a stress yield joint for compression to a diameter (depth) to be sized to siding material with no backing material. In a first alternative embodiment, for particular adaptation to plastic siding, the yield joint further comprises interlocking means to retain the corner in position when plastic siding with no backing is utilized.

9 Claims, 10 Drawing Figures

END JOINING PIECE ADAPTABLE TO EITHER HOLLOW OR INSULATED BACKING SIDING

BACKGROUND OF INVENTION

House siding, particularly that to give a clapboard appearance, has become extremely common in today's building materials. This siding falls into two general categories: plastic and metallic; the metallic being in most instances an aluminum composition. The panels in each instance have one of several designs to interlock and have alternate depths to accommodate insulation or a lesser depth referred to as "hollow backing".

The material is manufactured with the use of dies by either rolling or extruding and includes variour colors and textures. As in all mass produced materials, substantial inventories are maintained at the various marketing levels.

Particularly, the corner pieces require a different die to give a differnet depth to the panels, for that with insulation and that of hollow backing. On a continuous production, different machines will run the two types of corner pieces. Similarly, the inventories will also comprise stocking both "sizes". Again the different colors further compounds the production and stocking problems.

SUMMARY OF INVENTION

The present invention alleviates the above-noted production and stocking of different sizes for the corner pieces of siding. The preferred embodiment is directed to inside corner pieces and outside corner pieces with alternative embodiments for aluminum and plastic siding. The corner pieces has a stress yield point to permit compression to a different size upon application of force. In its first state the siding corner piece accommodates the siding with insulation. The same corner piece is used for siding with hollow backing by compressing it to size once it is in place. With aluminum the corner piece retains its compressed position whereas plastic siding will not. Accordingly, an interlocking means is utilized with the stress yield point to maintain the plastic corner piece in its compressed position.

OBJECTS

It is a principal object of the present invention to provide a corner piece for siding material that may be used with siding having an insulation backing and that having a hollow backing.

Other objects and features of the present invention will become apparent from the following detailed description when taken in conjunction with the drawings in which:

DETAILED DESCRIPTION OF PREFERRED EMBODIMENTS OF THE INVENTION

Figure 1:
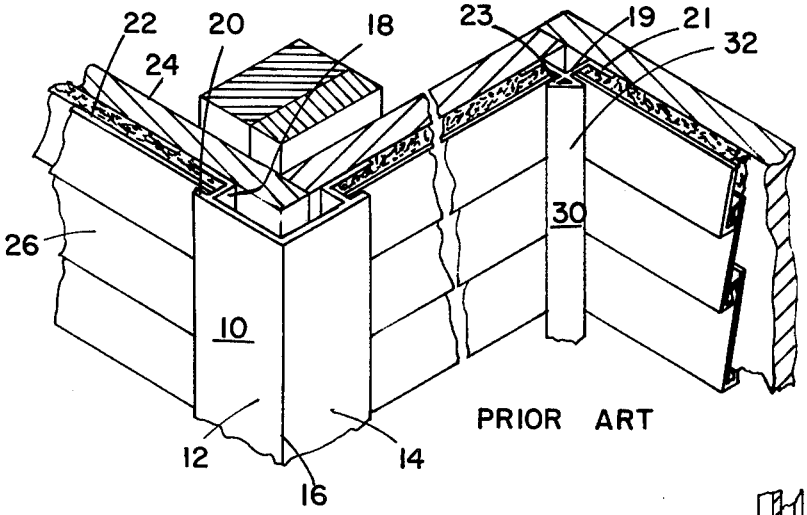
FIG. 1 illustrates a typical prior art outside and inside corner piece used with siding material.

With particular reference to FIG. 1 there is illustrated the siding corner of the prior art. Particularly the outside and inside corner piece used with siding material. The outside corner 10 comprising substantially perpendicular front panels 14, intersect in a vertical corner line 16. This corner line 16 forms the outside corner line of the building exterior. Channel forming members run vertically along the front panels 14. Each channel forming member consists of a rear vertical member 18 and a transverse vertical 20. The transverse vertical members 20 is substantially perpendicular to the rear vertical member 18. The rear vertical member 18 is parallel to its respective front panel 14. The transverse vertical members 20 run from the vertical edge of the rear vertical member 18 to a line of intersection with the front panel 14. The rear vertical members 18 are thus adapted, with appropriate nail holes, to be attached to the wall surfaces. In this way the corner pieces are secured to the front panels in a spaced relation to the wall surfaces. The rear panels, together with the transverse member and the front panels provide the outwardly opening channels. The rear vertical panel member 18 is spaced from front panel 14 an amount approximately equal to the overall thickness of the complete siding unit (meaning the siding unit with insulation board attached). In this way, when the siding units are inserted into the channels, the bottom edges of the panels will contact the front panels 12 and 14 and the insulation board will contact the rear panel 18. A solid external appearance is thus presented.

The inside corner 30 comprises substantially perpendicular front panels joined in front by a covering strip 32. In the interior corner channel forming member 30 the transverse panel members 19 run from the edges of the rear panel members 21 to the corner line. The rear panel member 21 is adaptable to be attached to the wall surfaces and are faced by the front panel structure 32. The channel forming member 30 receives the edges of the siding units 26 in the outwardly opening spacing between the rear panels 21 and the parallel wall 23.

Although the above has particular reference to the prior art outside and inside corner siding forming pieces, it can be readily appreciated that the same is equally applicable to straight panel joining pieces.

As can be seen in the prior art embodiment, the transverse face 20 must have a sufficient depth to accommodate the siding 26 having an insulating backing 22. Also envisioned is that the transverse face 20 should be no greater in depth than that of the siding when siding with no backing is utilized.

Referring now to FIGS. 2 through 9 there is illustrated the features of the present invention. Particularly with reference to FIG. 2 the outside corner 11 is in most respects that of the prior art illustrated in FIG. 1, with one major exception. The transverse face 21 in FIG. 2 has incorporated therein a stress yield point 15. In this particular embodiment, a V-shaped bend.

Figure 2:
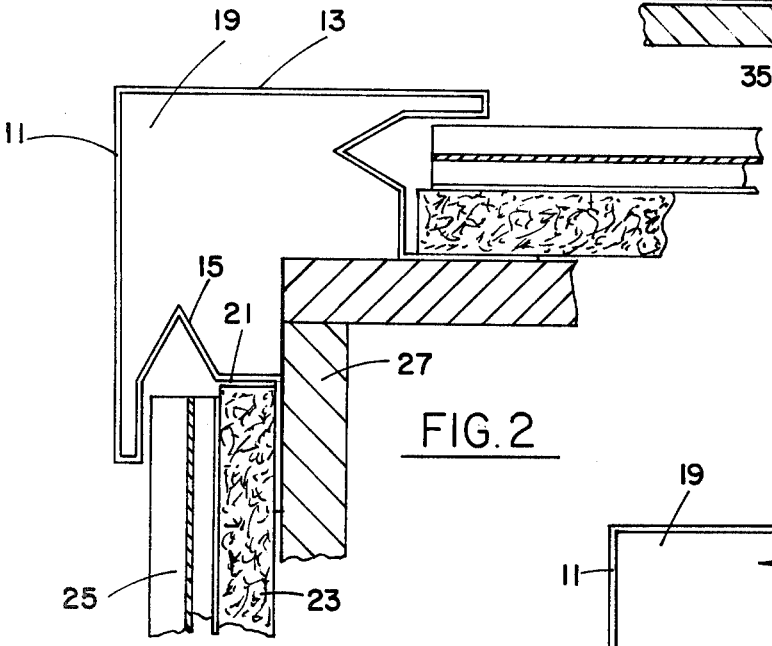
FIG. 2 illustrates the outside corner piece of the preferred embodiment when used with siding having an insulating backing.

With siding 25 having an insulation 23 there is little difference in function between the preferred embodiment of FIG. 2 and the prior art embodiment of FIG. 1. The V-shaped stress yield point in this instance has no function or advantage.

Figure 3:
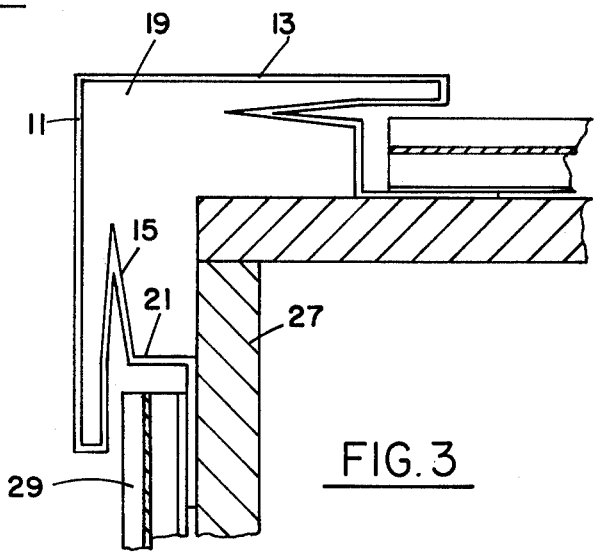
FIG. 3 illustrates the outside corner piece of the preferred embodiment when used with siding having an hollow backing.

However, with siding 29 of FIG. 3 having a hollow backing, the V-shaped stress yield does provide a very important structural advantage. In this embodiment of FIG. 3 the same corner piece is used as that of FIG. 2 except that it has succumbed to a force causing the stress yield point 15 to compress as shown.

The yield point V-shaped portion 15 of transverse wall 21 must be sufficient at its base to be reduced in size in an amount at least equal to the thickness of the insulation.

It is to be appreciated that other forms of the V-shaped yield point are equally operative. For instance, the accordian type of V-shaped transverse wall illustrated in FIG. 2A may be preferred in certain instances.

In that the same corner piece is utilized for either insulated or hollow backing siding, the manufacturing inventory advantages over the prior art can be readily appreciated. Particularly, a machine with one die can provide the entire inventory.

Figure 4:
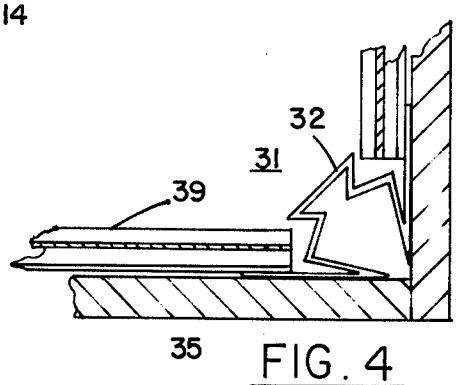
FIG. 4 illustrates the inside corner piece of the preferred embodiment when used with siding having an hollow backing.
Figure 5:
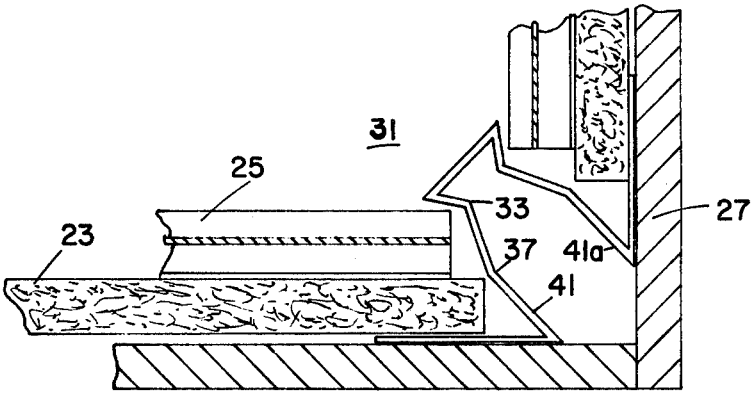
FIG. 5 illustrates the inside corner piece of the preferred embodiment when used with siding having an insulating backing.

With reference to FIGS. 4 and 5, there is illustrated the preferred embodiment incorporated in an inside corner for siding. The principle of its function is identical to that of the outside corner of FIGS. 2 and 3; that is, to be equally adaptable to sidings having different depths.

The structure of the inside corner 31 of the preferred embodiment, when in place will have the same appearance as that of 30 of the prior art shown in FIG. 1. That is, only front panels 32 of FIG. 4 and 32 of FIG. 1 are visible.

However, the internal structure of inside corner piece 31 of FIG. 5 is somewhat different to accommodate the yield stress points 33 and 37 on the transverse panels 41 and 41*a*.

Figure 2A:
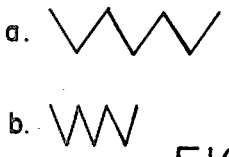
FIG. 2A illustrates at (a) a joining piece not compressed, and at (b) a joining piece compressed.

Again, the particular V-shaped yield points can be a slightly different configuration and also may be of the accordian V-shapes shown in FIG. 2A.

With reference now to FIGS. 6, 7, 8, and 9 there is shown the present invention adaptable to plastic siding. As known plastic siding is of a resilient material and will not retain its position if compressed.

Figure 8:
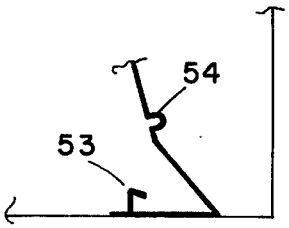
FIG. 8 is an alternative embodiment to the interlocking feature illustrated in FIG. 6.
Figure 6:
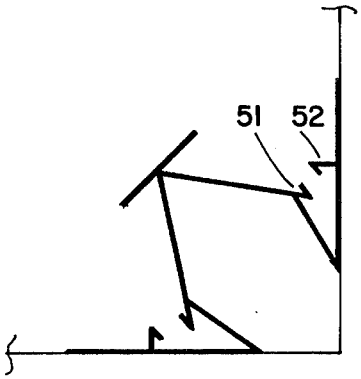
FIG. 6 illustrates the inside corner piece having an interlocking means to retain a compressed position.
Figure 7:
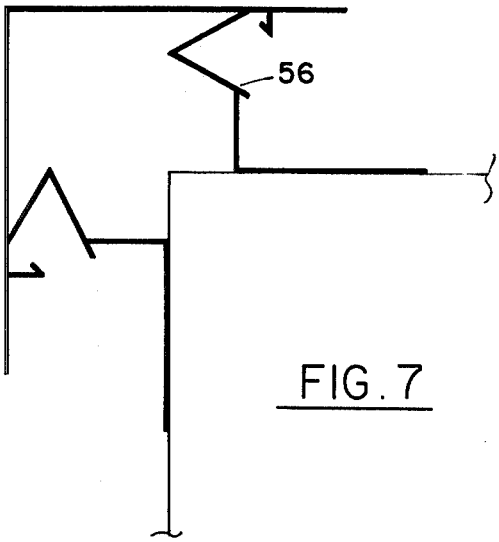
FIG. 7 illustrates an outside corner piece having an interlocking means to retain a compressed position.
Figure 9:
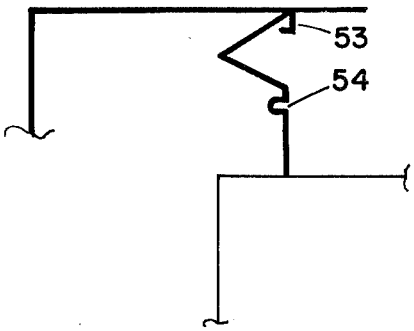
FIG. 9 is an alternative embodiment to the interlocking feature illustrated in FIG. 7.

In the plastic siding embodiment the yield stress points on the various transverse walls can be identical to that of the aluminum siding. The additional feature is an interlock to cause the plastic corners to retain their position when compressed. Preferably the interlock is a one direction slideable hook/hook arrangement 51/52 shown in FIG. 6. In FIGS. 8 and 9 the interlock is basically a hook 53 and a recess type of eye 54. The eye 56 in FIG. 7 takes still another shape. Other forms of the same principle of interlock may be utilized.

It can be appreciated that many variations of the interlock means shown can be had without departing from the spirit of the invention.

What is claimed:

1. A corner structure for simulating siding comprising, a first wall parallel to and adapted to be attached to the building corner, a front panel parallel to said first wall, and a transverse wall connecting said parallel walls;

said transverse wall further comprising a section having a yield stress point upon compression of a size to accommodate siding of a first depth and to a second depth when compressed, and wherein said yield section is of a size substantially equal to said differences of depth between said first and second depths.

2. The corner structure of claim 1 wherein said section having a yield stress point is V-shaped.

3. The corner structure of claim 1 wherein said V-shaped yield stress point is a series of V-shapes.

4. The corner structure of claim 1 wherein said structure is adaptable to an inside corner and said front panel is diagonal relative to said parallel walls, and wherein said yield stress point on said transverse walls comprises at least two V-shaped members.

5. The corner structure of claim 1 wherein said yield stress points on said transverse walls further comprises an interlock to retain said compressed position.

6. The corner structure of claim 5 wherein said interlock comprises a hook/hook arrangement.

7. The corner structure of claim 5 wherein said interlock comprises a hook/eye arrangement.

8. The corner structure of claim 1 wherein said section having a yield stress point is a reentrant bend.

9. The corner structure of claim 1 wherein said reentrant bend yield stress point is a series of bends.

* * * * *